US007146773B2

(12) United States Patent
Wilson

(10) Patent No.: US 7,146,773 B2
(45) Date of Patent: Dec. 12, 2006

(54) CONCRETE ACCEPTING WALL STRUCTURE WITH ADJUSTABLE CURVATURE

(75) Inventor: Jean-Laurent Wilson, Kirkland (CA)

(73) Assignee: Kafko Canada Inc., Mississauga (CA)

( * ) Notice: Subject to any disclaimer, the term of this patent is extended or adjusted under 35 U.S.C. 154(b) by 8 days.

(21) Appl. No.: 10/706,751

(22) Filed: Nov. 12, 2003

(65) Prior Publication Data

US 2004/0128937 A1 Jul. 8, 2004

Related U.S. Application Data

(60) Provisional application No. 60/425,296, filed on Nov. 12, 2002.

(51) Int. Cl.
*E04C 3/02* (2006.01)

(52) U.S. Cl. ..... 52/644; 52/223.6; 52/639; 249/18; 249/33; 249/155; 249/189

(58) Field of Classification Search ..... 52/415, 52/418, 421, 425, 426, 429, 479, 108, 248, 52/245, 630, 223.6, 639, 644, 223.12; 349/45, 349/78, 192, 193, 216; 249/10, 18, 155, 249/189, 196

See application file for complete search history.

(56) References Cited

U.S. PATENT DOCUMENTS

| | | | | |
|---|---|---|---|---|
| 992,835 | A | 5/1911 | Wiederholdt | |
| 1,041,389 | A | 10/1912 | Wiederholdt | |
| 2,197,318 | A | 4/1940 | Rumble | |
| 2,973,931 | A | 3/1961 | Brown | |
| 3,664,271 | A | 5/1972 | Wolder et al. | |
| 4,679,763 | A | 7/1987 | Brotherton | |
| 4,915,345 | A * | 4/1990 | Lehmann | 249/18 |
| 5,137,251 | A * | 8/1992 | Jennings | 249/189 |
| 5,535,565 | A * | 7/1996 | Majnaric et al. | 52/426 |
| 5,590,493 | A * | 1/1997 | Wilson | 52/108 |
| 5,706,620 | A | 1/1998 | De Zen | |
| 5,729,944 | A * | 3/1998 | De Zen | 52/439 |
| 5,806,266 | A * | 9/1998 | Jennings et al. | 52/644 |
| 5,974,751 | A | 11/1999 | De Zen | |
| 6,012,699 | A | 1/2000 | Wu et al. | |
| 6,094,877 | A * | 8/2000 | White | 52/247 |
| 6,189,269 | B1 | 2/2001 | De Zen | |
| 6,574,934 | B1 | 6/2003 | Queirel | |
| 2002/0083664 | A1 | 7/2002 | Queirel | |

FOREIGN PATENT DOCUMENTS

| | | |
|---|---|---|
| EP | 1 035 273 A1 | 9/2000 |
| FR | 2 756 856 | 12/1996 |
| WO | WO 94/16175 | 7/1994 |

* cited by examiner

*Primary Examiner*—Carl D. Friedman
*Assistant Examiner*—Yvonne M Horton
(74) *Attorney, Agent, or Firm*—Seyfarth Shaw LLP

(57) ABSTRACT

A structure for forming a vertically orientated wall comprises a flexible front panel having a longitudinal axis, a transverse axis and substantially continuous front surface; a flexible rear panel positioned rearwardly and parallel to the front panel; and a plurality of cross members connecting the front and rear panels. The front and rear panels define an upwardly opening cavity therebetween for accepting filler material, such as concrete therein. The rear panel includes at least one longitudinally disposed laterally deformable portion, such as a channel or zig zag pattern, which allows for the associated expanding and contracting of the rear panel during adjusting of the arcuate configuration of the wall structure.

9 Claims, 14 Drawing Sheets

CONCRETE ACCEPTING WALL STRUCTURE WITH ADJUSTABLE CURVATURE

RELATED APPLICATIONS

This application claims the benefit of the filing date of U.S. Provisional Application No. 60/425,296, filed Nov. 12, 2002 and incorporated herein by reference.

FIELD OF THE INVENTION

This invention relates to a concrete accepting wall structure with adjustable curvature.

BACKGROUND OF THE INVENTION

It is known to provide structures into which concrete or other filler material may be poured for forming a vertical wall, such as swimming pool walls. It is often desired to customize the arcuate configuration of such walls however, the size, shape and curvature of known concrete wall forming structures are commonly predetermined or are not easily adjustable. For example, U.S. Pat. No. 5,535,565 discloses a plurality of panels having a pair of opposed front and back face plates being interconnected at their ends by webs extending across the span between the face plates. The panel structures are not flexible. The curvature of the structure is predetermined by varying the length of connectors which are secured across front plates and back plates of adjacent panels.

U.S. Pat. No. 6,012,699 and U.S. Pat. No. 4,679,763 each discloses a metal form having a flexible panel member with a plurality of perimetral, spaced apart flanges projecting from one side thereof and having a face for forming concrete on the other side. The panel is flexed in a predetermined curvature and secured therein by a securing straps across adjacent flanges. To form a concrete wall structure, a pair of matching shaped wall structures must be arranged and stabilized a suitable distance apart for pouring concrete therebetween.

U.S. Pat. No. 4,915,345 discloses a concrete forming structure which may be preassembled into various arcuate curvatures. U.S. Pat. No. 5,729,944 discloses a concrete forming structure capable of accepting concrete therein, but its curvature is not adjustable.

SUMMARY OF THE INVENTION

It is an object of the invention to provide a wall structure capable of accepting filler material such as concrete therein having selectively adjustable arcuate configuration.

In accordance with an aspect of the invention there is provided a structure for forming a vertically orientated wall comprising a flexible front panel having a longitudinal axis, a transverse axis and substantially continuous front surface; a flexible rear panel positioned rearwardly and parallel to the front panel; and a plurality of cross members connecting said front panel and said rear panel. The front and rear panels define an upwardly opening cavity therebetween for accepting filler material therein. The rear panel includes at least one longitudinally disposed laterally deformable portion which allows for the associated deforming of the rear panel during adjusting of the arcuate configuration of the structure.

Preferred embodiments of the invention will now be described, by way of example, with reference to the accompanying drawings, in which:

BRIEF DESCRIPTION OF THE DRAWINGS

Similar reference numerals are used in different figures to denote similar components.

DETAILED DESCRIPTION OF EXAMPLE EMBODIMENTS OF THE INVENTION

Figure 1:
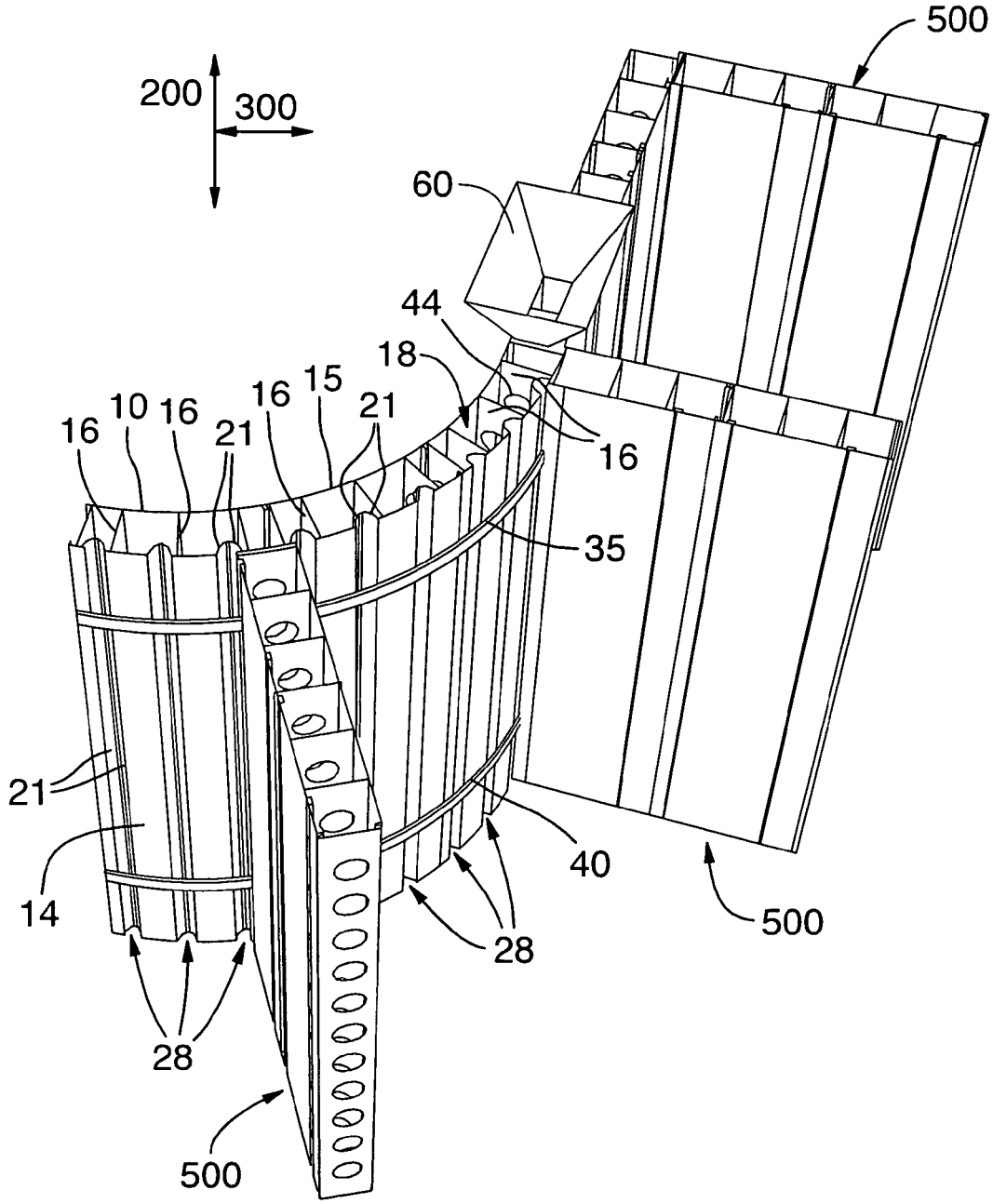
FIG. 1 is a perspective view of a first embodiment of wall structures in accordance with the invention.
Figure 2:
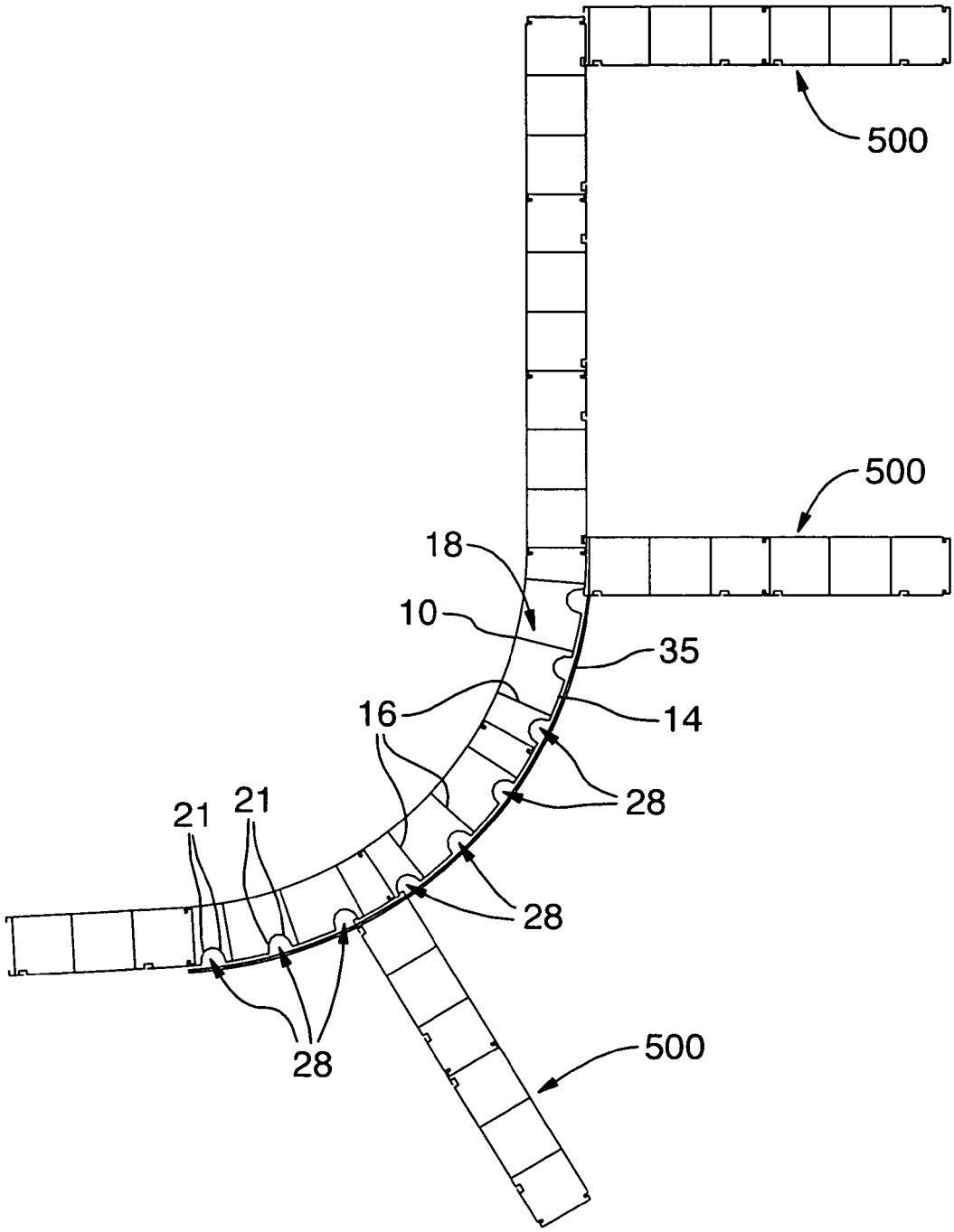
FIG. 2 is top view of a first embodiment of wall structures in accordance with the invention.
Figure 3:
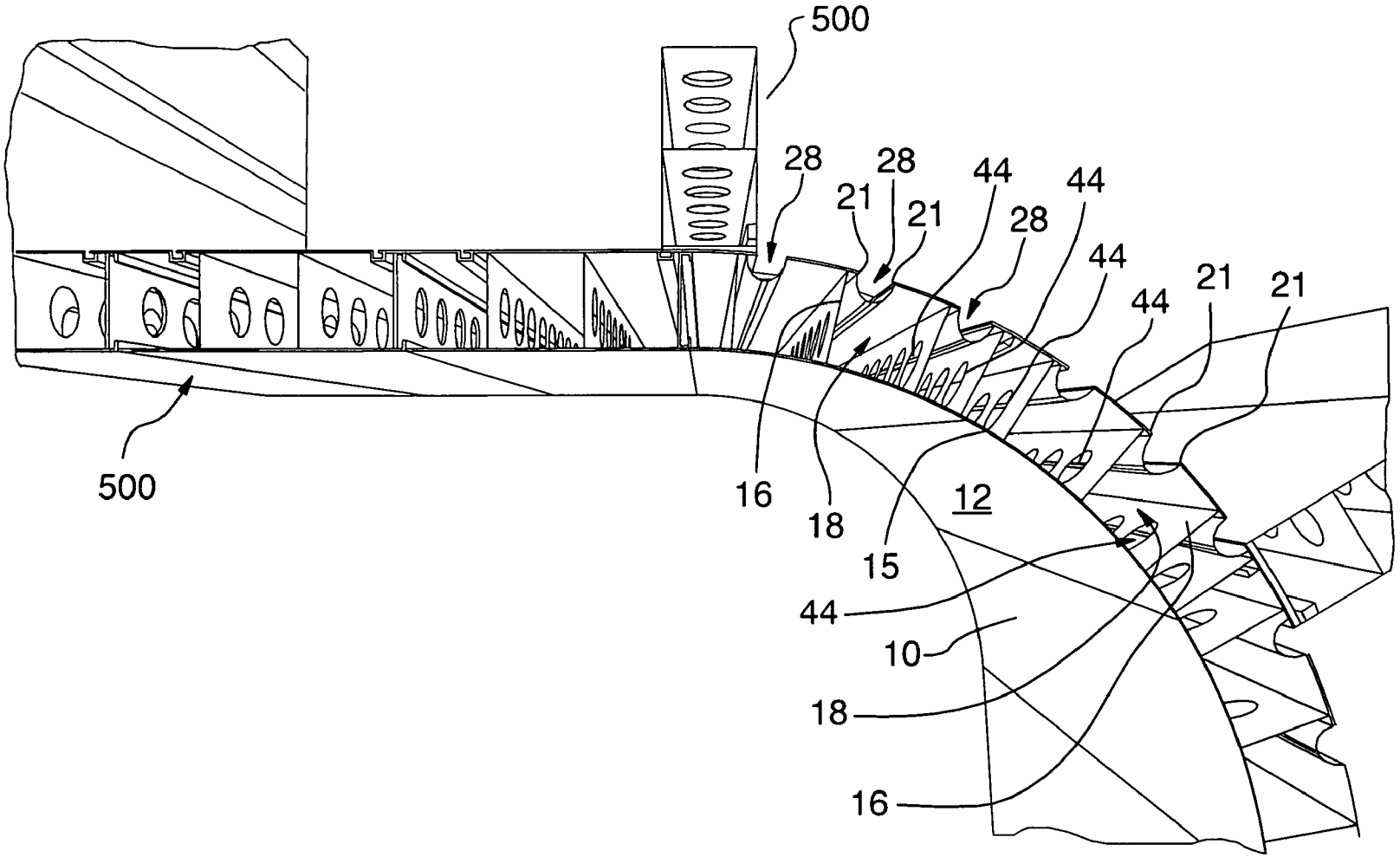
FIG. 3 is a top perspective view of a first embodiment of wall structures in accordance with the invention.

Shown in FIGS. 1 to 3 is a first embodiment of the invention. The curved wall structure indicated generally by the number (100) best illustrates the features of the invention. The wall structure (100) includes a flexible front panel (10) having a substantially continuous front surface (12) and a flexible rear panel (14). The front panel has a longitudinal axis (200) and a transverse axis (300). The front panel is connected to the rear panel by a plurality of cross members, which in the embodiment of FIGS. 1 to 3 take the form of a plurality of vertically extending regularly spaced parallel webs (16) extending perpedicularly to and between the front and rear panels. There is defined between the front and rear panels an upwardly opening cavity (18) into which filler material, such as concrete may be poured. Other filler material which may be utilized may be sand, gravel, foam or any other suitable filler material. Each web (16) defines a plurality of openings (44) therethrough which allows filler material, such as concrete to communicate between portions of the cavity (18) separated by webs (16), and thereby allow filler material, such as concrete, to settle within the wall in a uniform manner once poured in.

The front (10) and rear panels (12) and cross members, such as webs (16) may be integrally formed to each other or may be comprised of different pieces which can be secured to each other by any suitable means, such as mechanical fastening means or vertically extending tongues and grooves positioned on adjacent pieces arranged for attachment together.

The wall structure (100) is positionable in a straight configuration or in various configurations, be they convex, concave or a combination thereof. Filler material, such as concrete may be poured into cavity (18) by any suitable means such as manually with a shovel and wheelbarrow or the like, with the assistance of a funnel or hopper (60) such as is illustrated in FIG. 1, or by a mechanical pumping device. Although not explicitly illustrated, a cross member, such as a web (16) positioned at the end of the wall structure (100) may not include openings (44) therein in order to contain the filler material within the cavity (18) between the panels. Straight portions (500) cannot be bent into various arcuate configurations Portions (500) can be joined with the wall structure of the invention (100) in various manners to form wall structures with combined straight and arcuate configurations.

Figure 11:
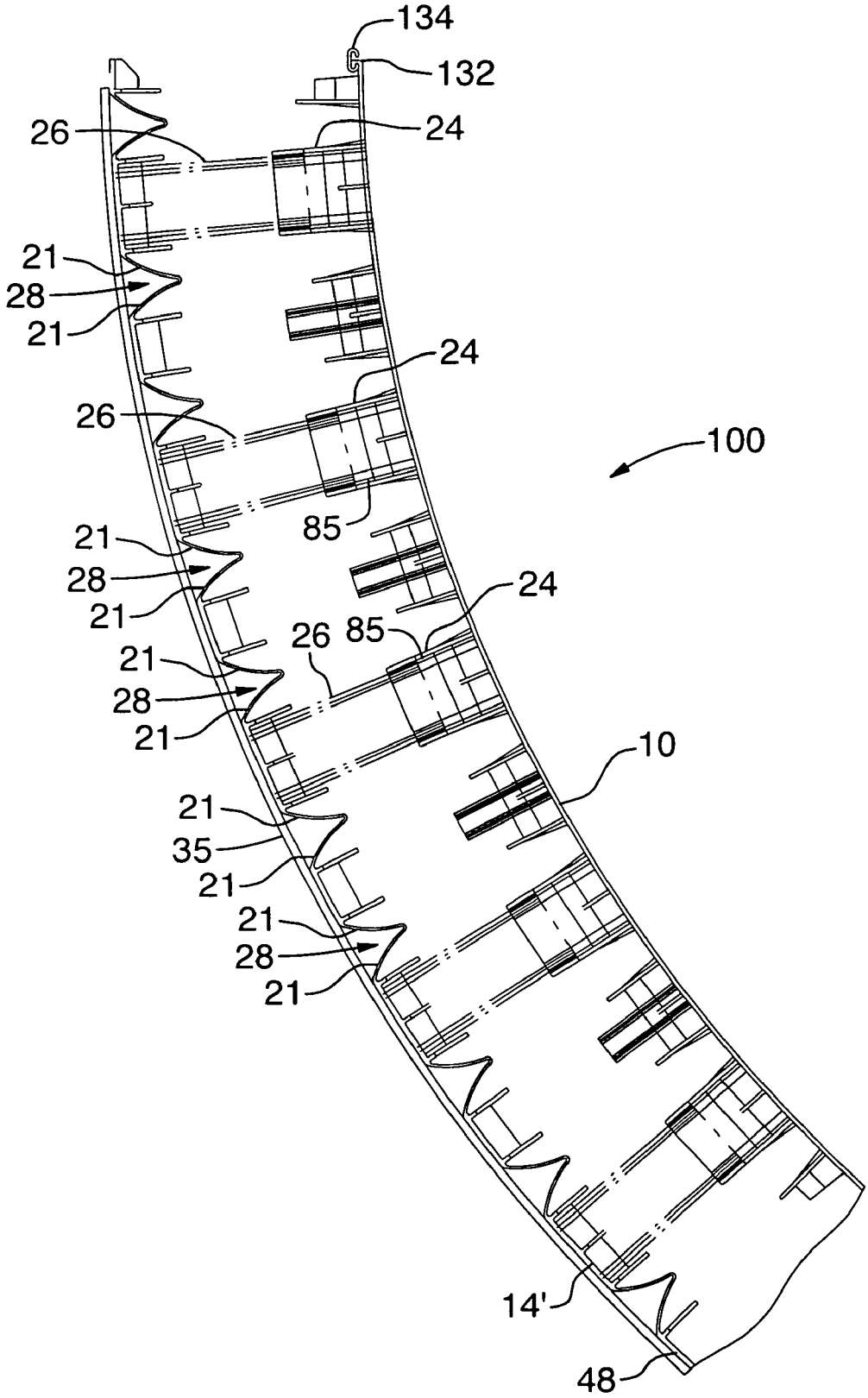
FIG. 11 is a top view of the embodiment of the wall structure of FIG. 5 formed as a concave front wall structure.
Figure 12:
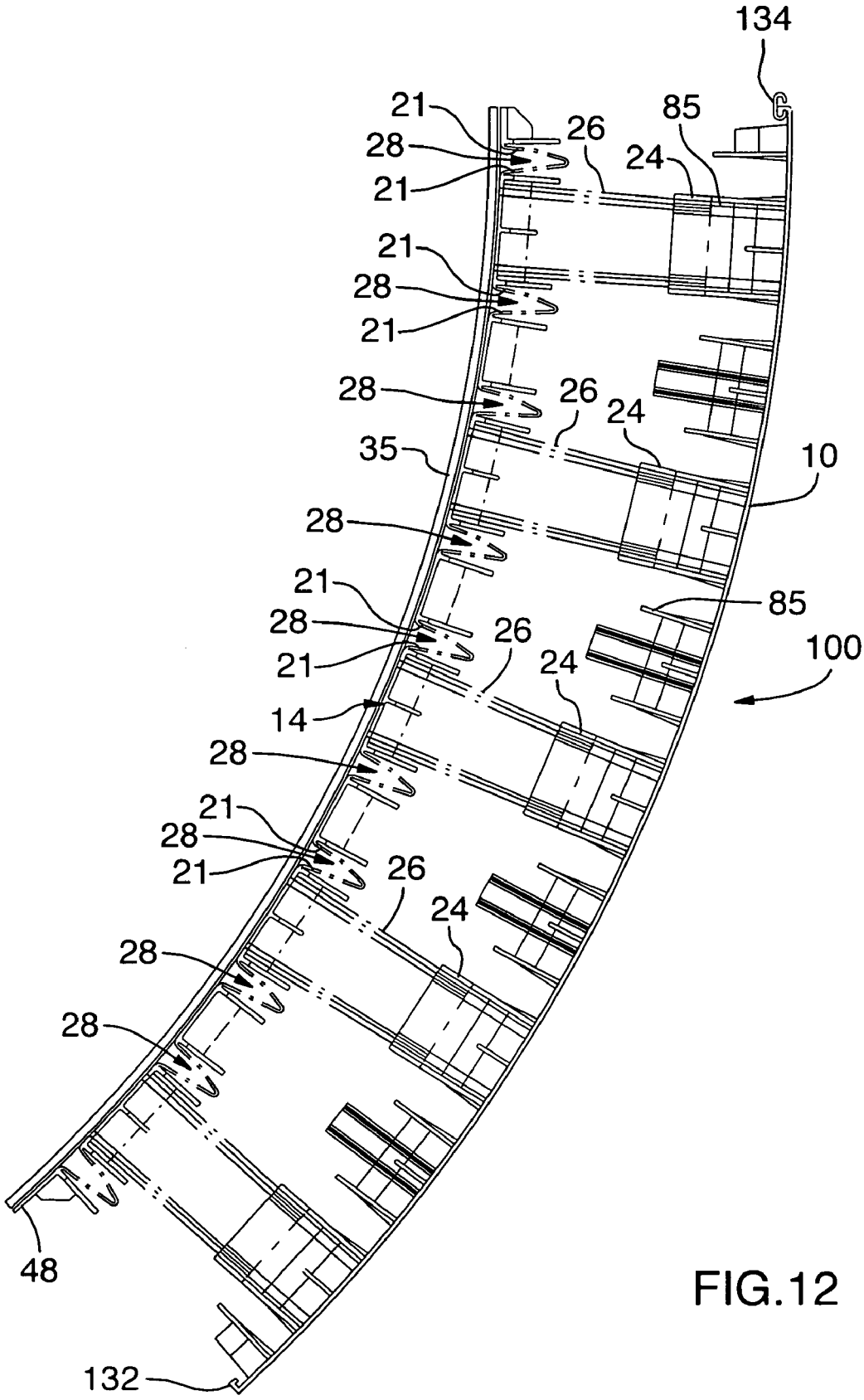
FIG. 12 is a top view of the embodiment of the wall structure of FIG. 5 formed as a convex front wall structure.

When utilized in the construction of a pool wall, the front surface (12) forms the surface against which a pool liner may be positioned. The pool liner may be secured to the upper edge (15) of the front panel in any known manner and may extend over the front surface (12) acting as a water boundary. The rear panels (14) include at least one and preferably a plurality of longitudinally disposed laterally deformable portions (such as channel 28) which allow for the associated lateral deformation of the rear panel as the structure's arcuate configuration is varied. Such lateral deformation may comprise lateral expansion during the forming a concave front wall and lateral contraction during the forming of a convex front wall. This expansion or contraction of the rear panel during flexing allows the front and rear panels to remain substantially parallel to each other when being bent into various arcuate configurations, both convex and concave. The distance between the front and back panels typically would be in the range of 3 to 12 inches but could vary outside this range and may in fact be any desired such distance. A preferred distance is 6 inches. An example of a laterally deformable portion is shown in FIGS. 1 to 3 and 5 to 13 as a plurality of vertically extending laterally expandable and contractable channels (28) formed in the rear panel, running parallel to each other, preferably between adjacent cross members, such as webs (16) or hollow members (22) or any other suitable cross members. For example, although not shown, the front panel may be secured to the back panel using resilient snap fitting clips which extend from one panel and resiliently and releasably lock into engagement with a mating member on the other panel. The channels are defined by opposing channel edge sections (21). As can be best seen in FIGS. 5 to 8, opposing channel edge sections (21) of each channel are spaced apart from each other when the wall structure is in a straight configuration. By being spaced apart, the distance between the opposed channel sections is able to contract as the wall is flexed rearwardly for forming a convex front wall (such as is shown in FIG. 12) and to expand as the wall is flexed forwardly for forming a concave front wall (such as is shown in FIG. 11).

Figure 14:
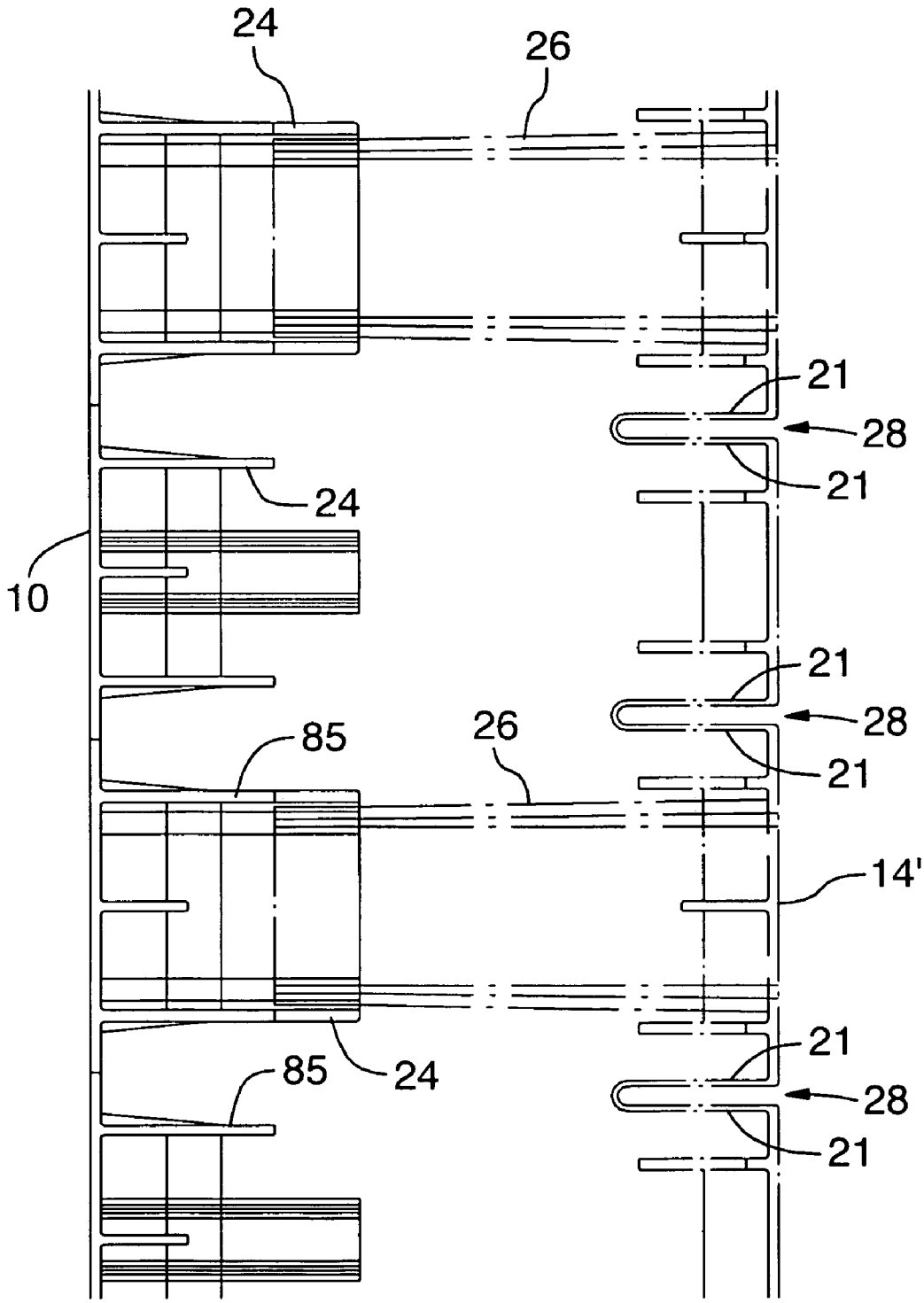
FIG. 14 is a top view of an alternate embodiment of the invention.

Although the embodiments shown in the Figures illustrate channels having opposed channel edge sections spaced apart from each other in the straight configuration, it should be understood that the opposing channel edge sections (21) of each channel (28) may be positioned adjacent each other when said wall structure is in a straight configuration, as can be seen in FIG. 14. This configuration would only allow for lateral expansion of the rear wall and thus is only suitable for forming a concave front wall.

Figure 4:
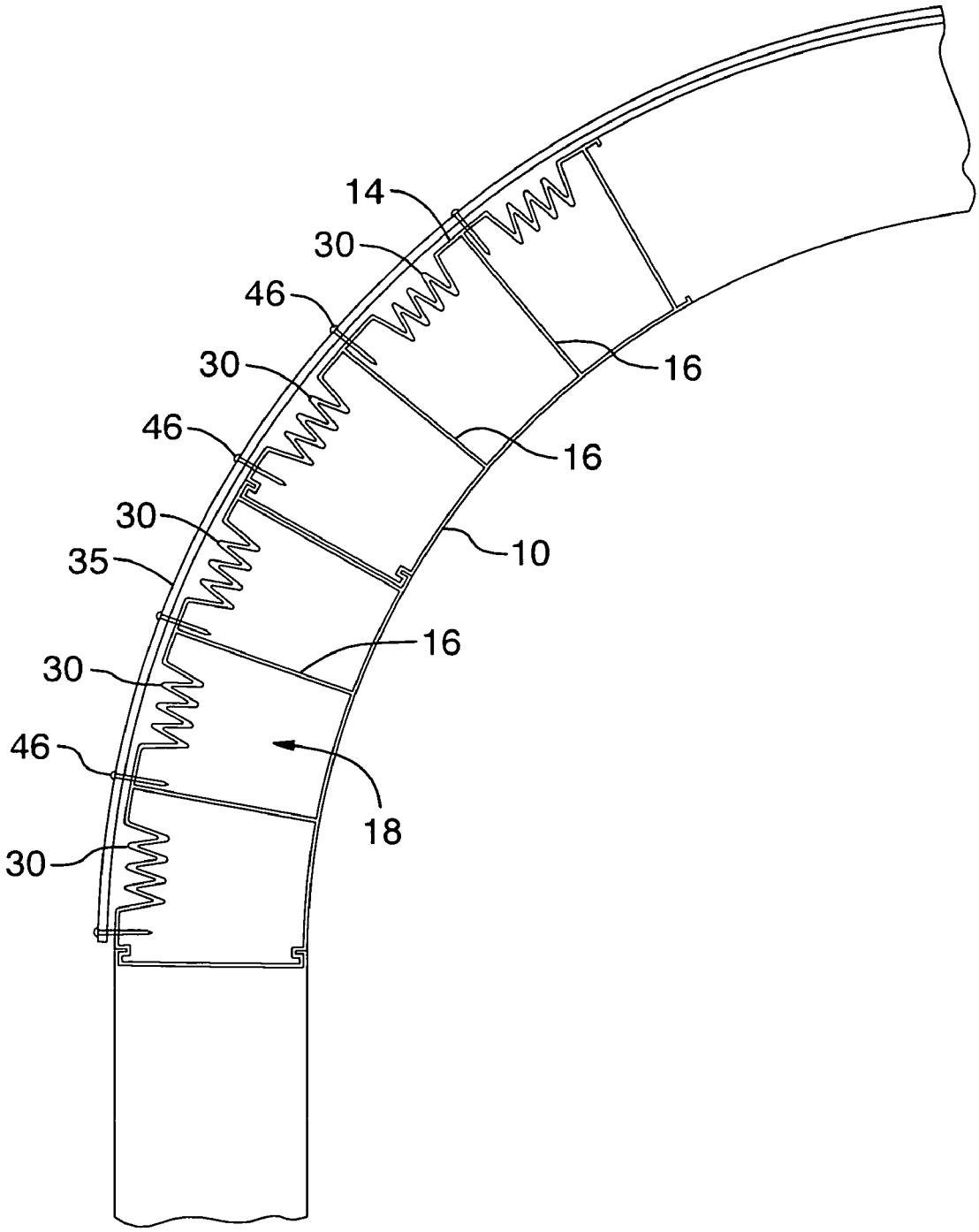
FIG. 4 is a top view of a portion of a second embodiment of a wall structure in accordance with the invention.

As shown in the embodiment of FIG. 4, in an alternate embodiment, the rear panel flex accommodating means comprises a plurality of vertically extending flexing zig-zag patterns (30) each positioned between adjacent cross members, such as webs (16). Just as with the flexing channels (28), the flexing zig zag patterns (30) allow the rear panel to expand as the structure is configured for forming a concave front wall or to contract as the structure is configured for forming a convex front wall.

Once the wall structure has been bent into the desired arcuate configuration, reinforcing straps (35, 40) may be secured laterally across the back of the rear wall panels by any suitable mechanical securing means, such as screws, rivets or the like. For example, as shown in FIGS. 1 and 2, there may be provided an upper strap member (35) and a lower strap member (40) each of which has apertures formed therein, which allows for a mechanical fastening device to be inserted through the apertures to secure same to the rear of the rear panel once the desired curvature of the wall structure has been set.

Once the desired curvature has been set, filler material such as concrete may then be poured into the upwardly opening cavity (18) defined between the front and back panels. The openings in webs (44) allows concrete to communicate between portions of the cavity separated by webs (16), and thereby allows concrete to settle within the wall in a uniform manner.

Adjacent wall structures of the embodiment of FIGS. 1 to 4 may be secured together by mechanical fastening means, i.e. rivets or screws (46) or the like being inserted through overlapping side edge portions (48) of the wall structure, or by means of a vertically extending extrusion (134), placed over adjacent vertically extending inwardly protruding members (132) positioned on side edge portions (130) of the panels. The extrusion fits over adjacent inwardly protruding members (132), securing adjacent peripheral portions of the wall structure together, as will be discussed in more detail below. Alternately, side edge portions of adjacent panel sections may include vertically extending inward slots and protrusions respectively which may be shaped to be fit together and thus secure adjacent side edge portions together. In any event, adjacent wall structures may be secured together in any known manner.

It should be understood that the wall structure may be positioned at various degrees of curvature or it may be positioned into straight portions. Such straight portions may be reinforced with reinforcing straightening members (55) such as that shown in FIG. 5.

Figure 5:
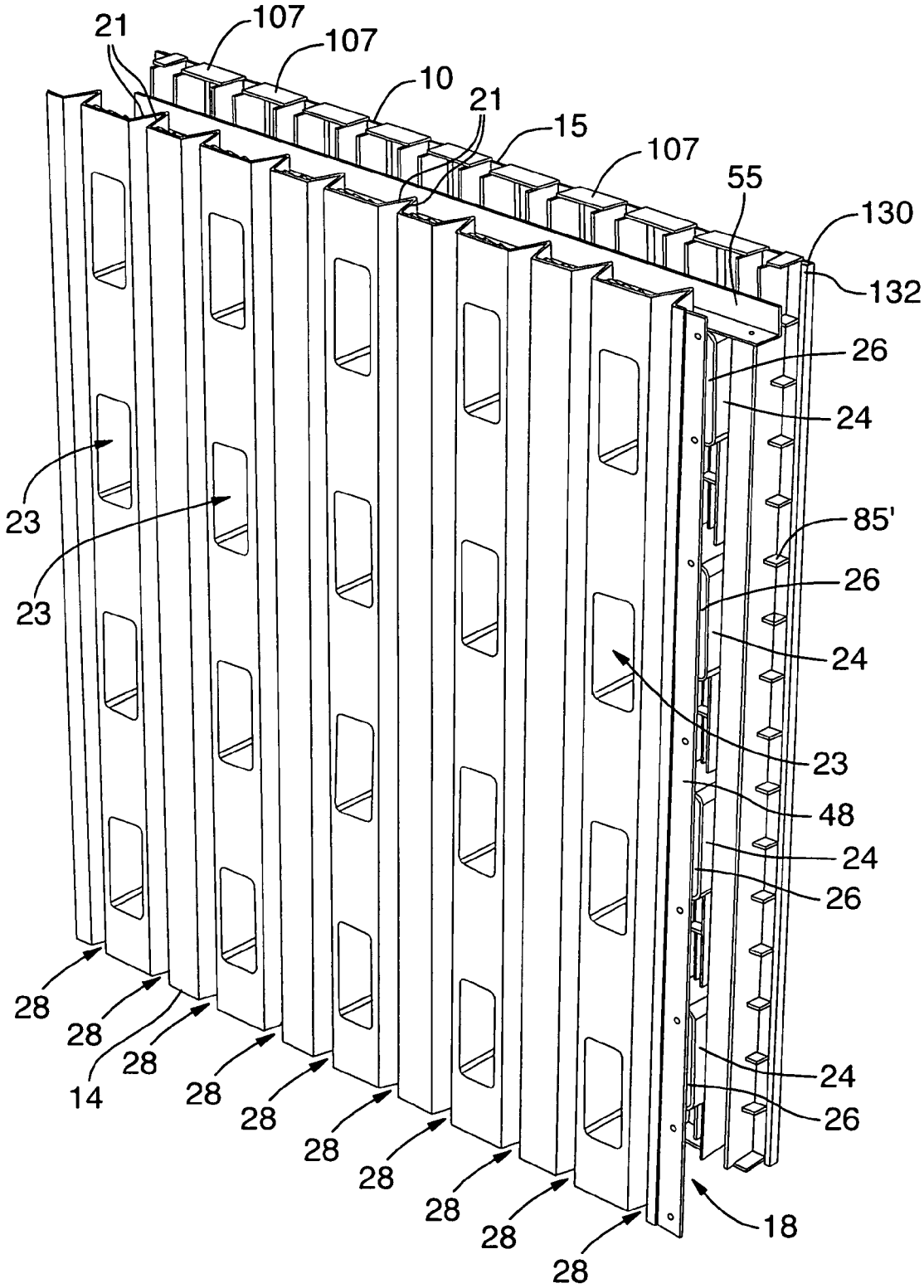
FIG. 5 is a rear perspective view of a third embodiment of an assembled wall structure in accordance with the invention.
Figure 6:
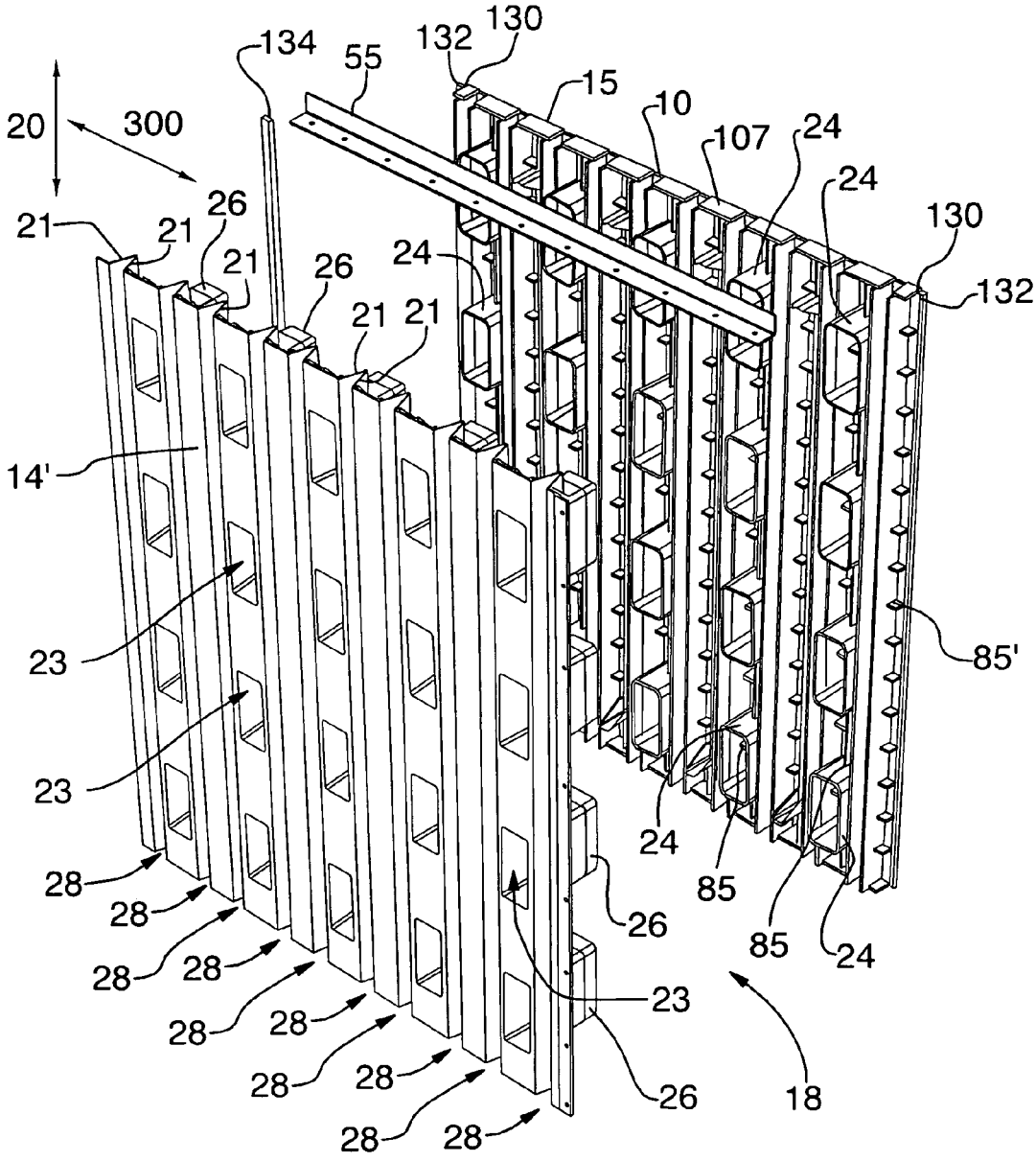
FIG. 6 is an exploded perspective view of the wall structure of FIG. 5.

Shown in FIGS. 5 to 13 is a further embodiment of a wall structure in accordance with the invention. The wall structure of this embodiment of the invention includes a flexible front panel (10) having a continuous front surface (12) and flexible rear panel (14'). The front panel is connected to the rear panel by means of cross members, which in this embodiment are hollow structures 22. Each hollow structure 22 comprises a hollow receiving member (24) rearwardly extending from the front panel, each defining a rearwardly orientated opening and a plurality of forwardly extending mating members (26), each mating member preferably defining an open space therein (23) and being shaped and aligned to be inserted into the receiving members (24) of the front panel. The wall structure is assembled together by aligning the panels, and inserting the mating members (26) into the receiving members (24), such that upwardly opening cavity (18) is defined between the front and rear panels. Once the front and rear panels are inserted together as shown in FIGS. 5, 7 to 13, they may be affixed together by any means known in the art or any other suitable means such as for example with a spring loaded clip, a rod piercing the front and back panels and secured in place by cross pins, screws, or molding clips through joined mating receiving (24) and mating members (26). The front and rear panels of FIG. 5 are preferably formed by injection molding process. The structure of FIGS. 1 to 3 may be formed from extruded polyvinylchloride. The upper edge of the front panel may include a plurality of rearwardly extending flanges (107). In the embodiment of FIGS. 5 to 13 the receiving members (24) are secured in place into the desired location onto rearwardly facing holding members (85) which are positioned to support the receiving members. This allows for the selective placement of the receiving members as desired. As can be seen in FIGS. 8, 9, 11, 12 and 14 certain holding members (85) act to limit the extent to which mating member (26) is inserted into receiving member (24) by blocking mating member (26) from full insertion into receiving member (24). The holding members and other rearwardly protruding members 85' on the rear surface of the front panel, positioned in parallel vertical alignment, confer rigidity and strength to the front panel. Holding members (85 and 85') may also be positioned on the rear panel, if desired.

Although the embodiment of FIGS. 5 to 13 shows the receiving members (24) on the front panel and the mating members (26) on the rear panel, it should be understood that the receiving member (24) may be positioned on the rear panel and the mating member (26) on the front panel. If in fact the mating members (26) are positioned on the front panel, unlike the mating members (26) shown in FIGS. 5 to 13, these would not form an open space extending through the front panel itself such as open space (23) since the front face of the panel must be a continuous surface for forming, for example, a pool wall water boundary side surface. As such, the mating member would be hollow and extend from the rear surface of the front panel. Similarly to the embodiment of FIGS. 1 to 3, the rear panel of the embodiment of FIGS. 5 to 13 includes longitudinally disposed laterally deformable portions such as for example a plurality of vertically extending "v" or "u" shaped channels (28) running parallel to each other positioned between adjacent hollow structure cross members. The laterally deformable portions, such as channels (28) allows the rear panel to laterally expand as the arcuate configuration is adjusted for forming a concave front wall (as shown in FIG. 11) and to laterally contract as the arcuate configuration is adjusted for forming a convex front wall (as shown in FIG. 12). As shown in FIGS. 5 to 13, vertical columns of evenly spaced hollow structures (22) comprising receiving (24) and mating member (26) are arranged between the front and rear panels. For example, in the embodiment of FIGS. 5 to 13, a row of four evenly spaced hollow structures (22) are positioned between adjacent channels. Preferably, the space defined within the structures (22) substantially reduces the capacity of the filler material accepting cavity (18), thereby reducing the amount of concrete required for the wall structure. In fact, the space within the hollow members may be approximately 15% to 50% of the total space defined within the cavity between the front and rear panel with a specific example having the hollow members comprising approximately 30% of the total space of the cavity.

Although the longitudinally disposed laterally deformable portions shown in FIGS. 5 to 13 are channels (28), it should be understood that the laterally deformable portions may comprise zig-zaged or "w" shaped formations (such as zig-zag formation (30) shown in FIG. 4 or any other suitably shaped which would accommodate lateral expansion and/or contraction of the rear panel as the arcuate configuration of the wall structure is varied.

Figure 13:
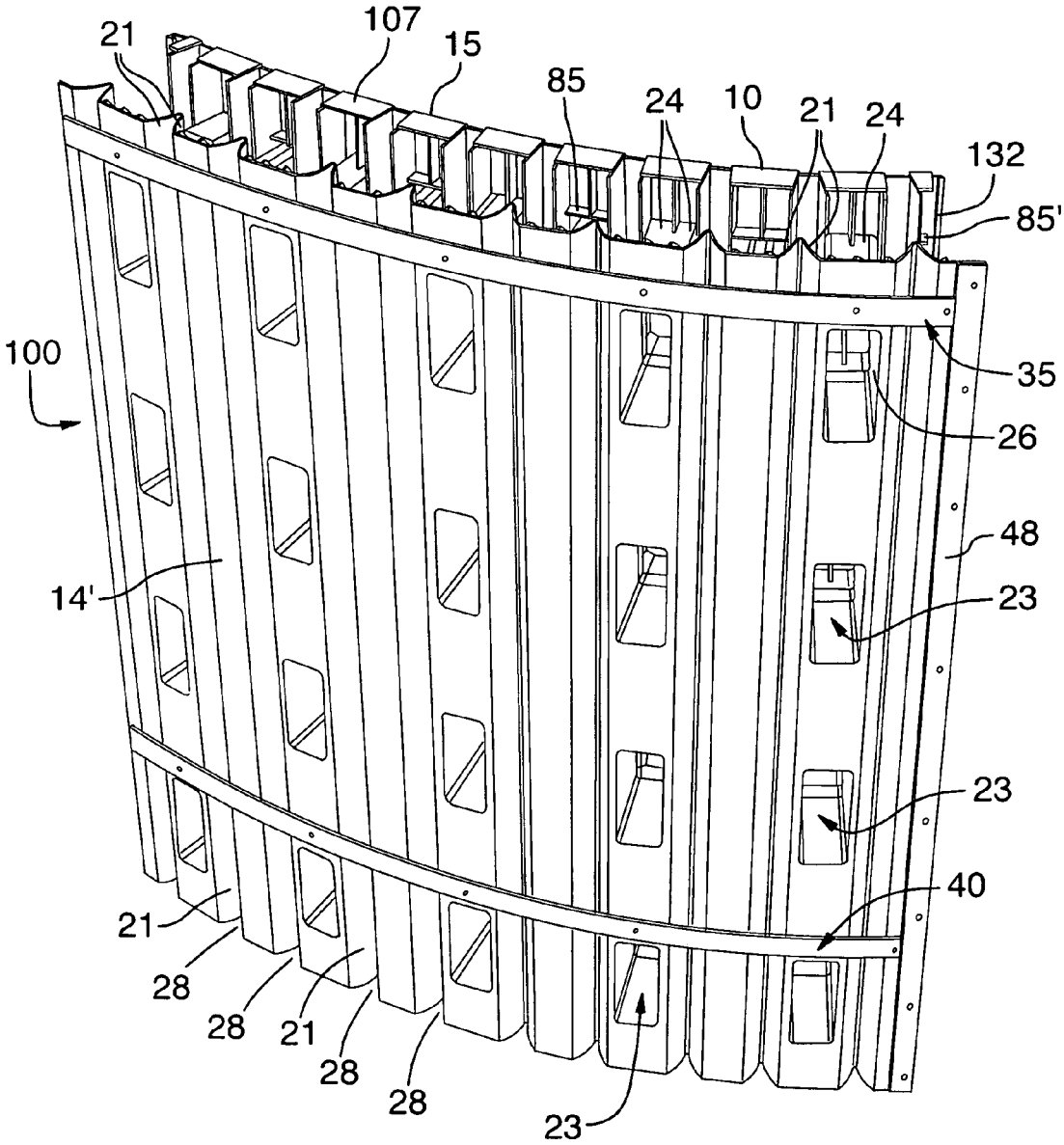
FIG. 13 is a further perspective view of the wall structure of FIG. 5 having formed as a concave front wall structure.

FIG. 11 shows the wall structure with the front wall curved in a forwardly curved concave configuration, with the "v" shaped channels (28) of the rear panel expanded. FIG. 12 shows the wall structure curved in a convex configuration showing the "v" shaped channels (28) in the rear panel in a contracted position. The wall structure's curvature may be fixed by means of the reinforcing straps (35,40) which may be secured across the back of the rear panels perpendicular to the length of the panels by any suitable mechanical securing means, such as rivets or the like. For example as shown in FIG. 13 (in the same manner shown in FIGS. 1 and 2), there may be provided an upper strap member (35) and a lower strap member (40) each of which has apertures formed therein, which allows for a mechanical fastening device to be inserted through the apertures to secure same to the rear of the rear panel once the desired curvature of the wall structure has been set.

The wall structure may be formed in a straight configuration, without any curvature applied thereto such as is shown in FIGS. 5 to 10. To reinforce the wall structure in this straight orientation, a straightening rod (55) may be attached to the rear of the front panel, the rod extending laterally across the front panel (10). The rod (55) adds rigidity and provides support to it in this position. The rod preferably includes apertures extending therethrough and may be secured to the upper surface of upwardly positioned holding members (85) positioned on the rear of the front panel by any suitable mechanical fastening means such as a screw or rivet or the like.

Figure 9:
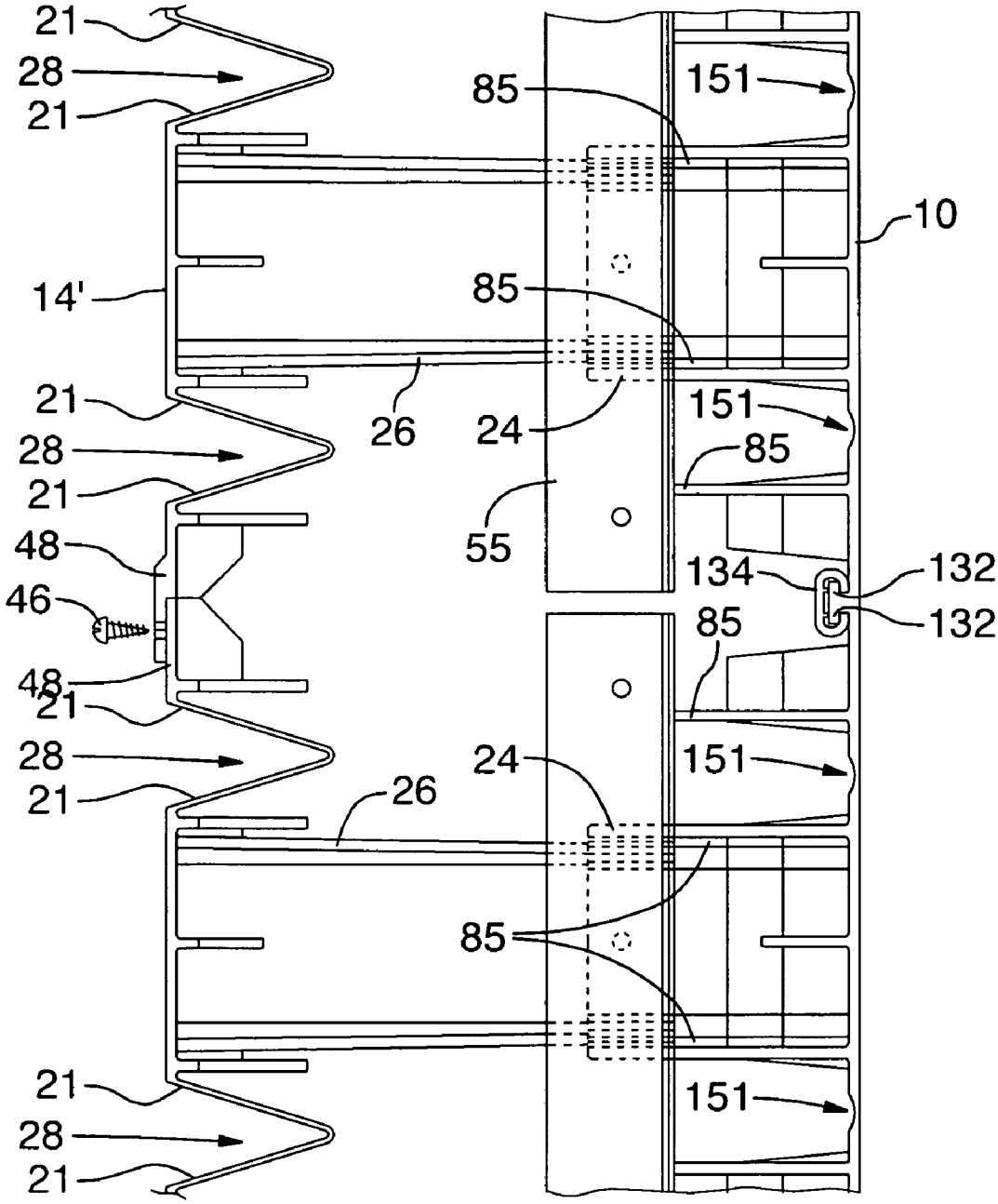
FIG. 9 is a section view of portions of adjacent wall structures of FIG. 5, secured together.
Figure 10:
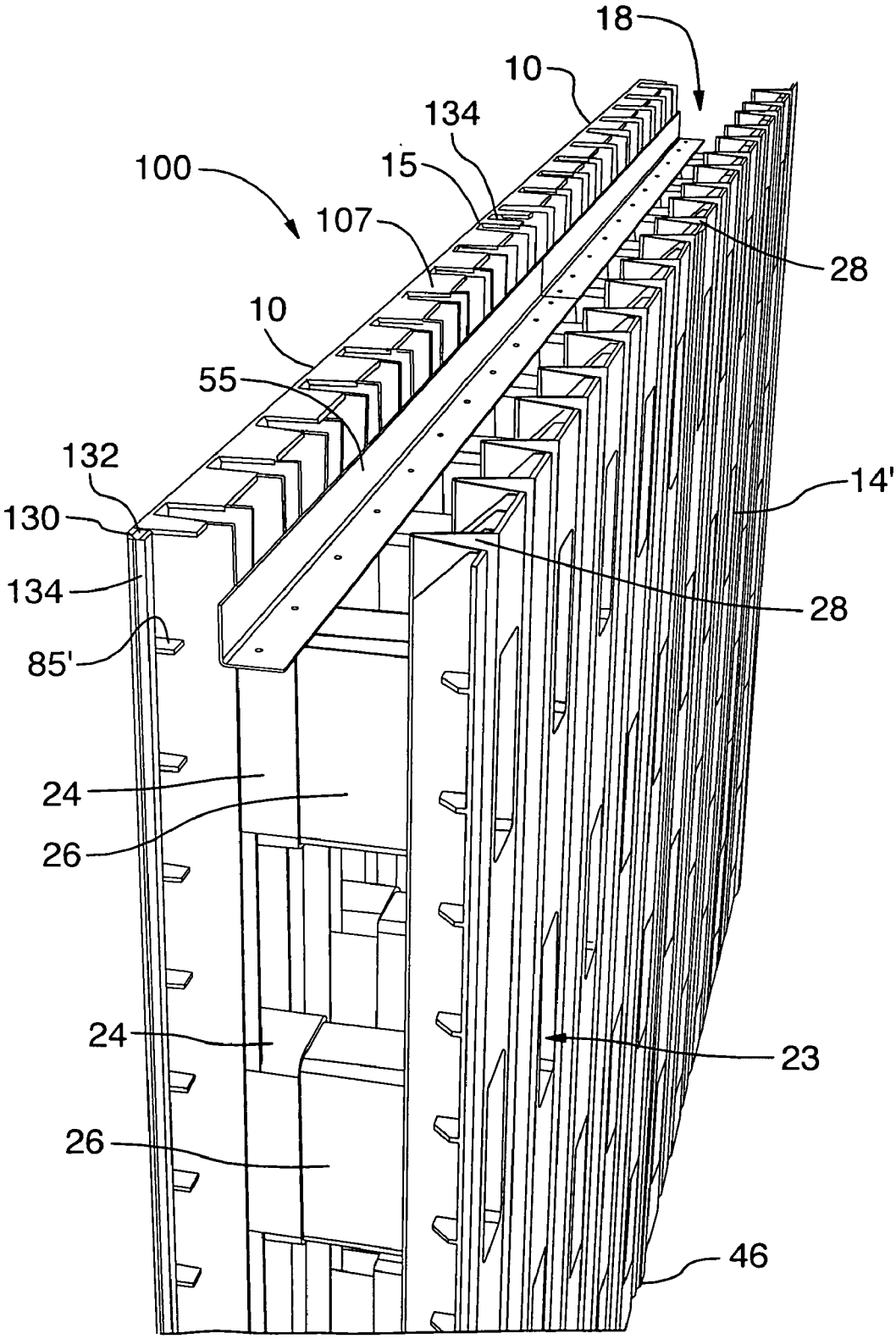
FIG. 10 is a further perspective view of adjacent wall structures of FIG. 5.

The front panel of the embodiment of FIGS. 5 to 13 may include a plurality of parallel vertically extending grooves (151) as can be seen in FIG. 9, positioned between cross members, which form lines of weakening or areas of reduced thickness which aid in the ability to adjust the curvature of the wall.

As is best seen in FIG. 9, adjacent wall structures may be secured together in the following manner. Each side edge portion (130) of the front panel includes rearwardly (also considered inwardly) protruding vertical members (132). As can be seen in FIG. 9, these vertical members (132) sit adjacent to each other when adjacent wall structure portions are positioned side by side. A vertically extending extrusion (134) may be inserted over the adjacent vertically extending members in tight fit therewith, pressing them together in tight fit engagement. By securing the front panel together in this manner, the front faces of adjacent front panels may be continuous thereby providing a suitable inner surface for a pool and pool liner. The rear panel may also have side edge portions which include forwardly (also considered inwardly) protruding vertical members (132). The vertical members of the rear panel (132) would be secured together by inserting extrusion 134 over adjacent members (132) and pressing them together in tight fit engagement. The vertical members (132) on the rear panel may be positioned inwardly or rearwardly.

Figure 7:
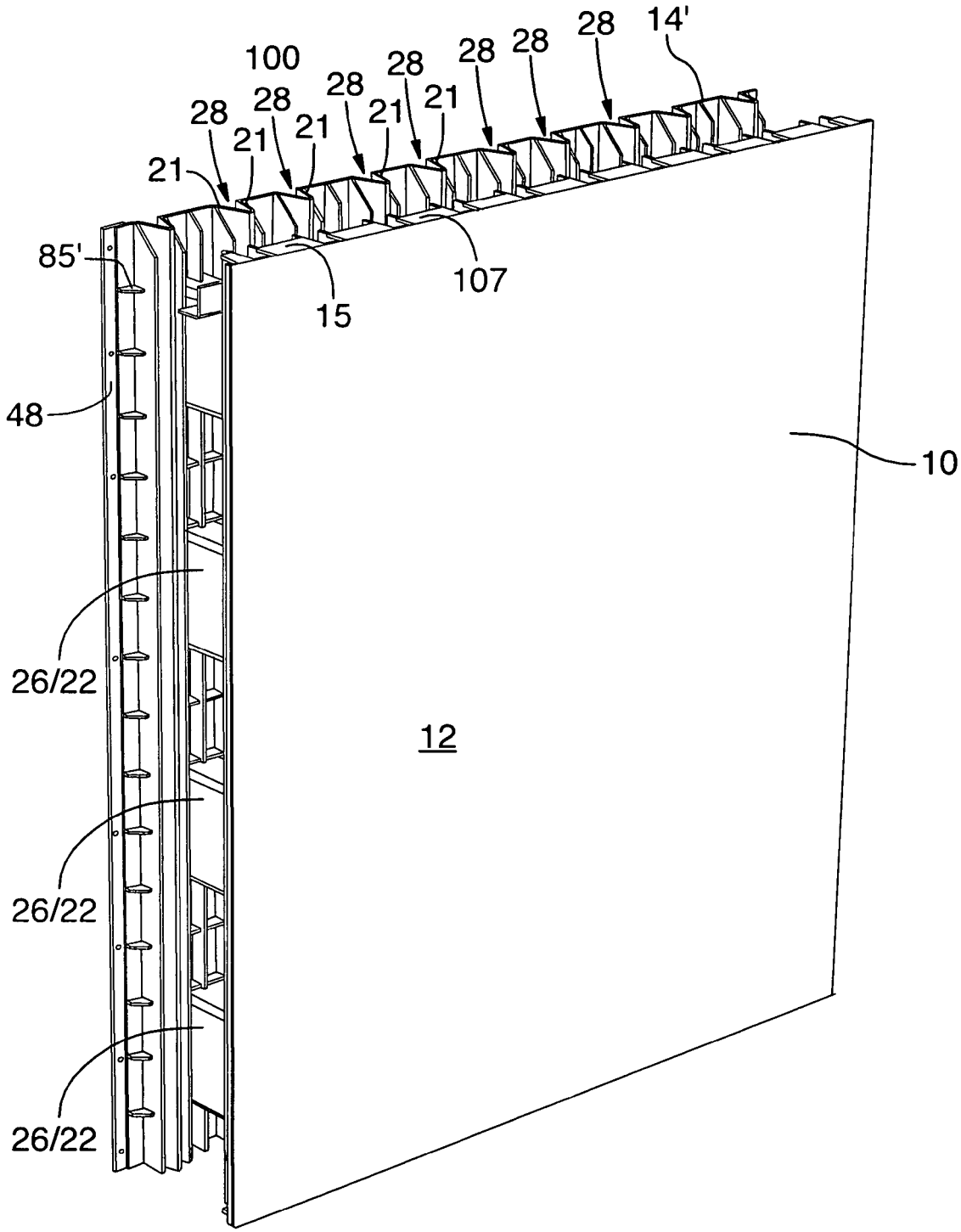
FIG. 7 is a front perspective view of the wall structure of FIG. 5.
Figure 8:
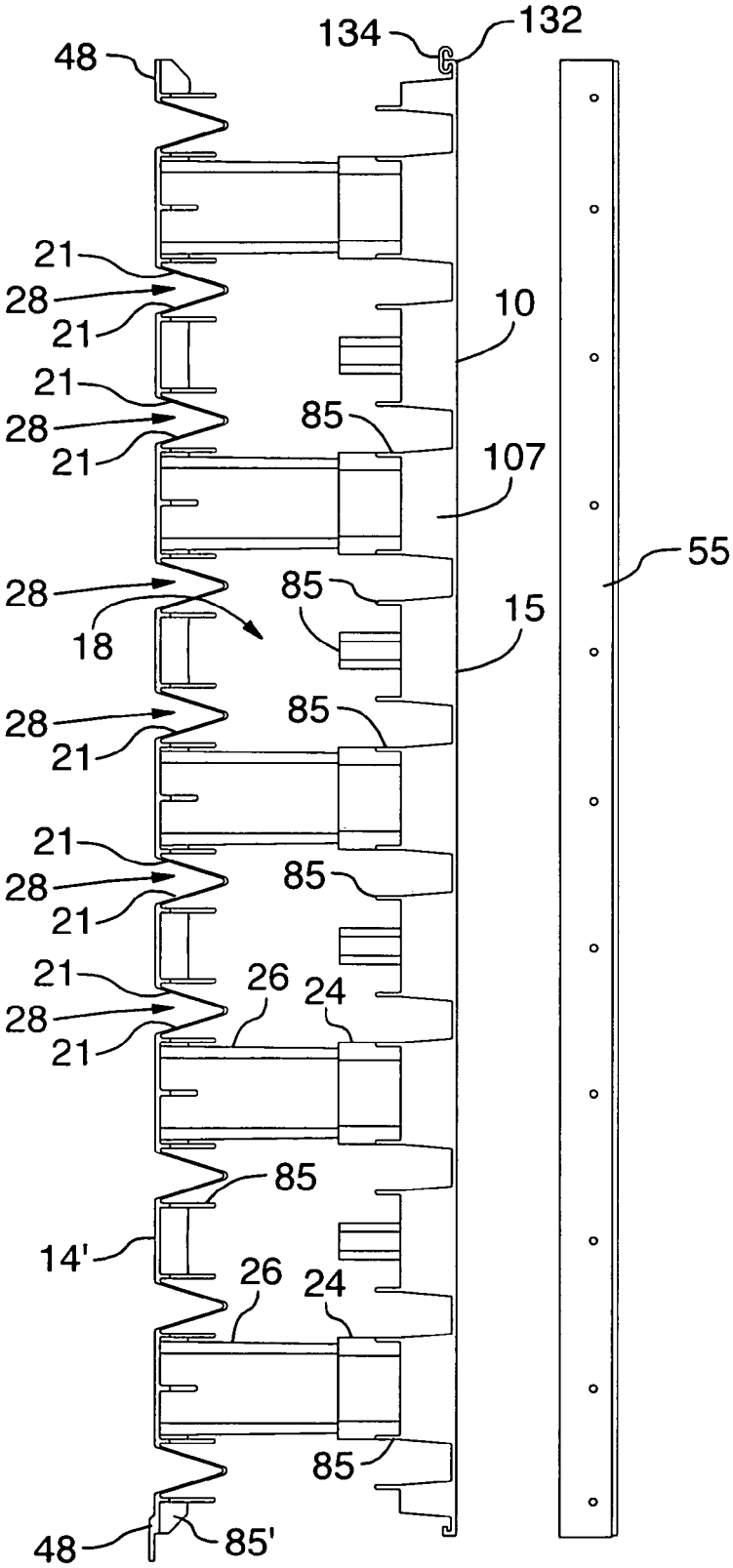
FIG. 8 is a lateral sectioned view of the wall structure of FIG. 5.

Alternately, as can be seen in FIGS. 7 and 9, as a means to secure adjacent structures together, the rear panel side edge portions (130) include apertures extending therethrough. Side edge portions of adjacent rear panels may overlap with each other and the apertures therethrough of each align such that they may be secured together by inserting rivets or the like through the apertures.

The panels of the wall structure are comprised of any suitably flexible material, although structural foam material is widely used for such structure. An example of a preferred material is polyethylene or polypropylene. Although, it should be understood that any material having the required strength and rigidity and which can be adapted for the purposes of the present invention could be used. The structure and components thereof may be formed by injection molding process or alternately may be formed from extruded polyvinylchloride (PVC).

It should be understood that although a preferred application of the wall structure in accordance with the invention is as a swimming pool wall, the wall structure may be used to form constructions walls of various applications.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

The invention claimed is:

1. A structure for forming a vertically orientated wall comprising:

a flexible front panel having a longitudinal axis, a transverse axis and substantially continuous front surface;

a flexible rear panel positioned rearwardly and parallel to the front panel; and a plurality of cross members connecting said front panel and said rear panel, said front and rear panels defining an upwardly opening cavity therebetween for accepting filler material therein, said rear panel including at least one longitudinally disposed laterally deformable portion which allows for the associated deforming of the rear panel during adjusting of the arcuate configuration of the structure, said at least one longitudinally disposed deformable portion is laterally expandable to allow for the lateral expansion of said rear panel as the structure is configured to form a concave front wall, said at least one longitudinally disposed laterally deformable expandable portions is also laterally contractable to further allow for the lateral contraction of said rear panel as the structure is arcuately configured rearwardly to form a convex front wall, wherein said deformable laterally expandable and contractable portions each comprise a longitudinally disposed zig-zag pattern formed in said rear panel.

2. A structure for forming a vertically orientated wall comprising:

a flexible front panel having a longitudinal axis, a transverse axis and substantially continuous front surface;

a flexible rear panel positioned rearwardly and parallel to the front panel; and a plurality of cross members connecting said front panel and said rear panel, said front and rear panels defining an upwardly opening cavity therebetween for accepting filler material therein, said rear panel including at least one longitudinally disposed laterally deformable portion which allows for the associated deforming of the rear panel during adjusting of the arcuate configuration of the structure, said cross members including a plurality of parallel vertically extending regular spaced webs extending perpendicularly to and between said front and rear panels.

3. A structure as recited in claim 2 wherein each said web defines a plurality of openings therethrough.

4. A structure as recited in claim 3 wherein said openings are regular spaced along the length of each web.

5. A structure for forming a vertically orientated wall comprising:

a flexible front panel having a longitudinal axis, a transverse axis and substantially continuous front surface;

a flexible rear panel positioned rearwardly and parallel to the front panel; and a plurality of cross members connecting said front panel and said rear panel, each said cross member defining a hollow space therein, said front and rear panels defining an upwardly opening cavity therebetween for accepting filler material therein, said rear panel including at least one longitudinally disposed laterally deformable portion which allows for the associated deforming of the rear panel during adjusting of the arcuate configuration of the structure.

6. A structure for forming a vertically orientated wall comprising:

a flexible front panel having a longitudinal axis, a transverse axis and substantially continuous front surface;

a flexible rear panel positioned rearwardly and parallel to the front panel; and a plurality of cross members connecting said front panel and said rear panel, said front and rear panels defining an upwardly opening cavity therebetween for accepting filler material therein, said rear panel including at least one longitudinally disposed laterally deformable portion which allows for the associated deforming of the rear panel during adjusting of the arcuate configuration of the structure, said cross members each including a receiving member defining a hollow space therein attached to either said front panel or rear panel and a mating member secured to the opposite panel adapted to be inserted and secured in said receiving member.

7. The structure of claim 6, wherein the cumulative space within the cross members comprises between 15% and 60% of the total space within the cavity, thereby substantially reducing the amount of filler material required to be poured into the cavity.

8. The structure of claim 7, wherein the cumulative space within the hollow members comprises 30% of the cumulative space within the cavity.

9. A structure for forming a vertically orientated wall comprising:

a flexible front panel having a longitudinal axis, a transverse axis and substantially continuous front surface;

a flexible rear panel positioned rearwardly and parallel to the front panel; and a plurality of cross members connecting said front panel and said rear panel, said front and rear panels defining an upwardly opening cavity therebetween for accepting filler material therein, said rear panel including at least one longitudinally disposed laterally deformable portion which allows for the associated deforming of the rear panel during adjusting of the arcuate configuration of the structure, said front panel having side edge portions and a rearwardly extending longitudinal member extending along each side edge portion, and a vertical extrusion defining a groove therein into which the longitudinal members of adjacent wall structures may be inserted and secured thereby securing adjacent wall structures together.

* * * * *